US010605004B1

(12) United States Patent
Brunner et al.

(10) Patent No.: US 10,605,004 B1
(45) Date of Patent: Mar. 31, 2020

(54) INTELLEGENT BLAST-HOLE DRILL BIT WITH REDUNDANT TRANSDUCER WEAR SENSOR AND REMOTE RECESSED REFLECTOR ANTENNA

(71) Applicant: REI, Inc., Salt Lake City, UT (US)

(72) Inventors: Daniel J. Brunner, Salt Lake City, UT (US); Randy Richardson, South Jordan, UT (US); Robert Koontz, Herriman, UT (US); Randall Johnson, Salt Lake City, UT (US); Alex Schumacher, Salt Lake City, UT (US)

(73) Assignee: REI, Inc., Salt Lake City, UT (US)

( * ) Notice: Subject to any disclaimer, the term of this patent is extended or adjusted under 35 U.S.C. 154(b) by 118 days.

(21) Appl. No.: 15/660,611

(22) Filed: Jul. 26, 2017

Related U.S. Application Data

(60) Provisional application No. 62/466,188, filed on Mar. 2, 2017, provisional application No. 62/437,120, filed on Dec. 21, 2016, provisional application No. 62/368,807, filed on Jul. 29, 2016.

(51) Int. Cl.

| | |
|---|---|
| ***E21B 12/02*** | (2006.01) |
| ***E21B 4/10*** | (2006.01) |
| ***E21B 10/50*** | (2006.01) |
| ***E21B 1/02*** | (2006.01) |
| ***E21B 17/042*** | (2006.01) |
| ***E21B 10/36*** | (2006.01) |
| ***H01Q 1/52*** | (2006.01) |

(52) U.S. Cl.
CPC ..... *E21B 4/10* (2013.01); *E21B 1/02* (2013.01); *E21B 10/36* (2013.01); *E21B 10/50* (2013.01); *E21B 17/0426* (2013.01); *H01Q 1/523* (2013.01)

(58) Field of Classification Search
CPC .... E21B 12/02; B23Q 17/008; B23Q 17/0995
USPC ..... 175/39
See application file for complete search history.

(56) References Cited

U.S. PATENT DOCUMENTS

| | | | | |
|---|---|---|---|---|
| 7,168,506 | B2 * | 1/2007 | Boucher | E21B 47/01 175/48 |
| 7,363,988 | B2 * | 4/2008 | Jeffryes | E21B 44/00 175/39 |
| 9,464,487 | B1 * | 10/2016 | Zurn | E21B 47/01 |
| 2012/0152617 | A1 * | 6/2012 | Hunt | E21B 10/00 175/39 |
| 2014/0231142 | A1 * | 8/2014 | Poitzsch | E21B 47/065 175/50 |
| 2015/0322781 | A1 * | 11/2015 | Pelletier | E21B 3/00 175/41 |
| 2016/0153244 | A1 * | 6/2016 | Humphrey | E21B 12/02 175/39 |
| 2018/0106922 | A1 * | 4/2018 | Leuenberger | E21B 12/02 |
| 2018/0171772 | A1 * | 6/2018 | Rodney | E21B 49/00 |
| 2018/0180522 | A1 * | 6/2018 | Kalhori | B23B 27/1614 |
| 2019/0187321 | A1 * | 6/2019 | DiFoggio | G01N 17/043 |

(Continued)

*Primary Examiner* — Kenneth L Thompson
(74) *Attorney, Agent, or Firm* — Winstead PC

(57) ABSTRACT

An intelligent blast-hole drill bit that includes a housing embedded into a cavity in a bit body. A controller is disposed in the housing. An external antenna is disposed in the housing and coupled to the controller. An internal antenna is disposed in the housing and coupled to the controller. A wear transducer is disposed in the housing and coupled to the controller.

2 Claims, 15 Drawing Sheets

(56) References Cited

U.S. PATENT DOCUMENTS

2019/0292897 A1* 9/2019 Costa de Oliveira .. E21B 17/10
2019/0299352 A1* 10/2019 Michiwaki ..... B23C 5/16

* cited by examiner

INTELLEGENT BLAST-HOLE DRILL BIT WITH REDUNDANT TRANSDUCER WEAR SENSOR AND REMOTE RECESSED REFLECTOR ANTENNA

CROSS REFERENCE TO RELATED APPLICATIONS

This application claims priority to, and incorporates by reference, each of U.S. Provisional Patent Application No. 62/368,807; U.S. Provisional Patent Application No. 62/437,120; and U.S. Provisional Patent Application No. 62/466,188.

BACKGROUND

Field of the Invention

The present invention relates to monitoring of tool wear and more particularly, but not by way of limitation to monitoring of drill-bit or boring machine cutter wear and environmental status via a redundant sensor wear transducer with a remote recessed reflector antenna.

History of the Related Art

An antenna is an electrical device that converts electrical power into radio waves and vice versa. Typically, antennas are used with a radio transmitter or a radio receiver. In transmission, a radio transmitter supplies an electric current oscillating at radio frequency (i.e. a high frequency alternating current (AC)) to the antenna's terminals. The antenna radiates the energy from the current as electromagnetic waves (radio waves). In reception, an antenna intercepts some of the power of an electromagnetic wave in order to produce a voltage at its terminals, that is applied to a receiver to be amplified.

Antennas are essential components of all equipment that use radio and are used in systems such as, for example, radio broadcasting, broadcast television, two-way radio, communications receivers, radar, cellular phones, satellite communications, and the like. In addition, antennas are also used in devices such as, for example, wireless microphones, garage openers, RFID tags, Bluetooth enabled devices, and the like.

Typically, an antenna consists of an arrangement of metallic conductors electrically connected to a receiver or a transmitter. Such antennas are typically exposed from and/or extend outwardly of supporting structures. Such exposed antenna mountings/configurations do not lend themselves for use on "wear surfaces" and downhole drilling equipment where the antenna area could be impacted and/or abraded by external forces.

Addressing conventional antennas, an oscillating current of electrons forced through the antenna by a transmitter creates an oscillating magnetic field around the antenna elements, while the charge of the electrons also creates an oscillating electric field along the antenna elements. These time-varying fields radiate away from the antenna into space as a moving transverse electromagnetic field wave. Conversely, during reception, the oscillating electric and magnetic fields of an incoming radio wave exert force on the electrons in the antenna elements, causing them to move back and forth, creating oscillating currents in the antenna. For the antennas to effectively transmit signals, it is preferred to place the antennas on non-recessed surfaces.

SUMMARY

The present invention relates to monitoring of tool wear and more particularly, but not by way of limitation to monitoring of drill-bit or boring machine cutter wear and environmental status via a redundant sensor wear transducer with a remote recessed reflector antenna. An example of one embodiment is an intelligent blast-hole drill bit that includes a housing embedded into a cavity in a bit body. A controller is disposed in the housing. An external antenna is disposed in the housing and coupled to the controller. An internal antenna is disposed in the housing and coupled to the controller. A wear transducer is disposed in the housing and coupled to the controller.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
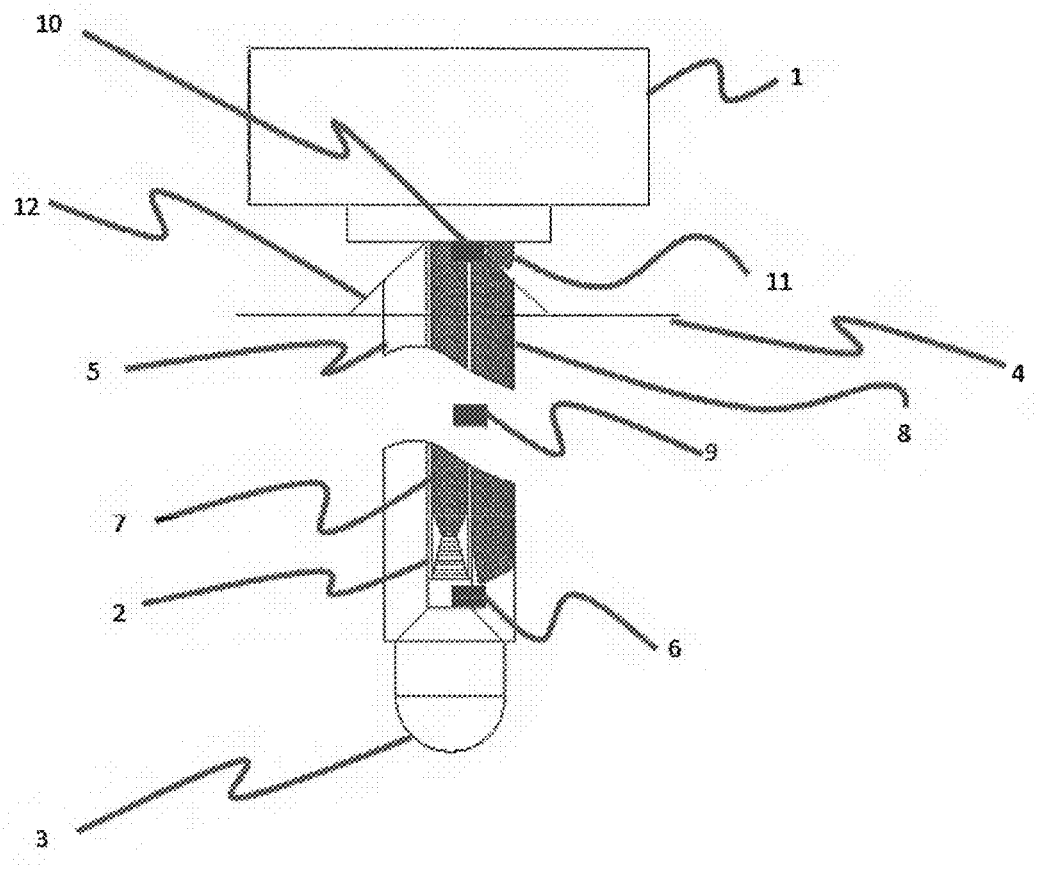
FIG. 1 is a cross-sectional elevation view of a blast-hole drilling system according to an exemplary embodiment.

Blast holes are used to load explosives to break up rock formations in mines to strip waste rock and gain access to ore bodies, and to break up ore bodies for mining purposes. A simplified blast hole drilling process is shown in FIG. 1. Drill rigs 1 (shown as blocks) are used to drive drill pipes 2 with a drill bit 3 on the lower end into the ground 4 drill bits 3 are used to cut or break up rock formation as the blast boreholes 5 are drilled. Sensors are added to the drill bit 3 and the sensor data is available to the drill rig 1 operator and other operations personnel. The purpose of the sensors is to monitor drill bit 3 parameters. The sensor data is collected by a controller 6 in the drill bit and transmitted via radio signals inside 7 the drill pipe 2 and radio signals outside 8 the drill pipe 2 to repeaters 9 (as needed) and subsequently to a transceiver 10 at the base of the drill rig 1. The upper transceiver 10 repeats the signals 11 at the top of the borehole or borehole cover 12 where it is received by drill rig computers, hand-held devices, wearable devices, nodes, or to a central monitoring location.

An Intelligent Blast-Hole Drill Bit with Redundant Transducer Wear Sensor and Remote Recessed Reflector Antenna enables an up-hole computer to receive wear status, bit temperature, precision real time bit shock and vibration, strain, pressure, and other sensor parameters to also derive bit-whirl, reliably and wirelessly from the drill bit up the blast hole. Redundant recessed reflector antennas installed in the bit transmit the data inside and outside the drill pipe so that if one path becomes blocked, the other may still be able to communicate.

Figure 2A:
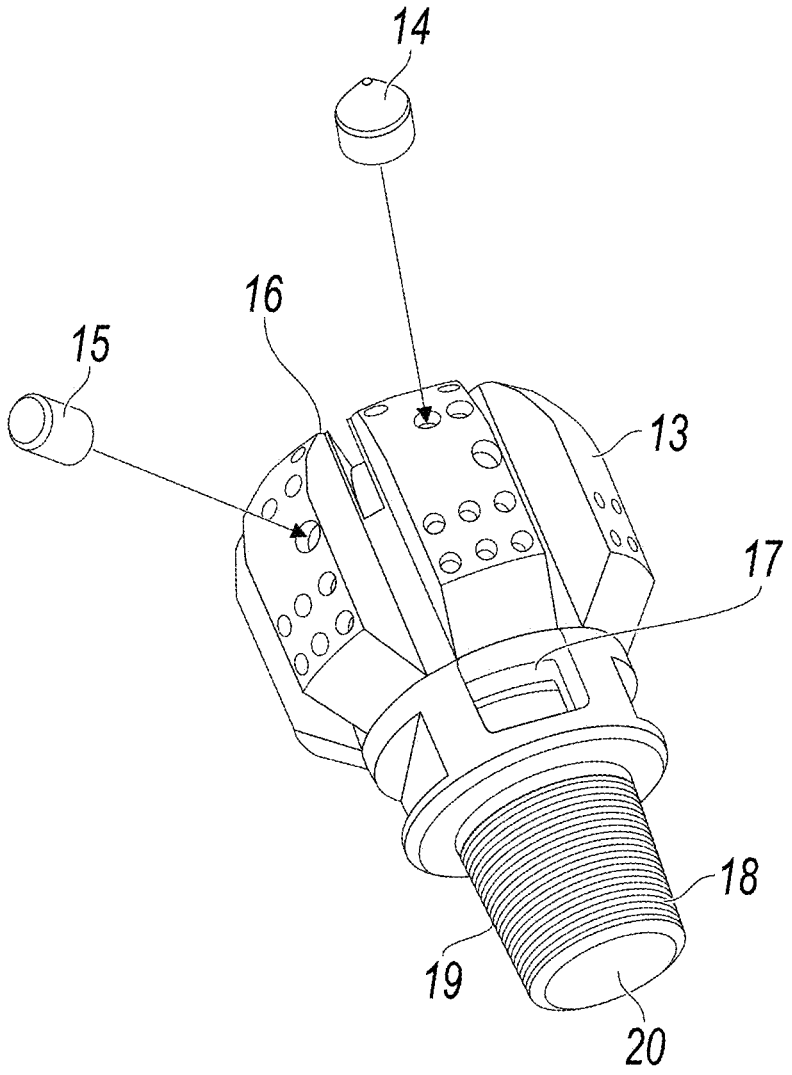
FIG. 2A is a perspective view of a blast-hole drill bit body according to an exemplary embodiment.
Figure 2B:
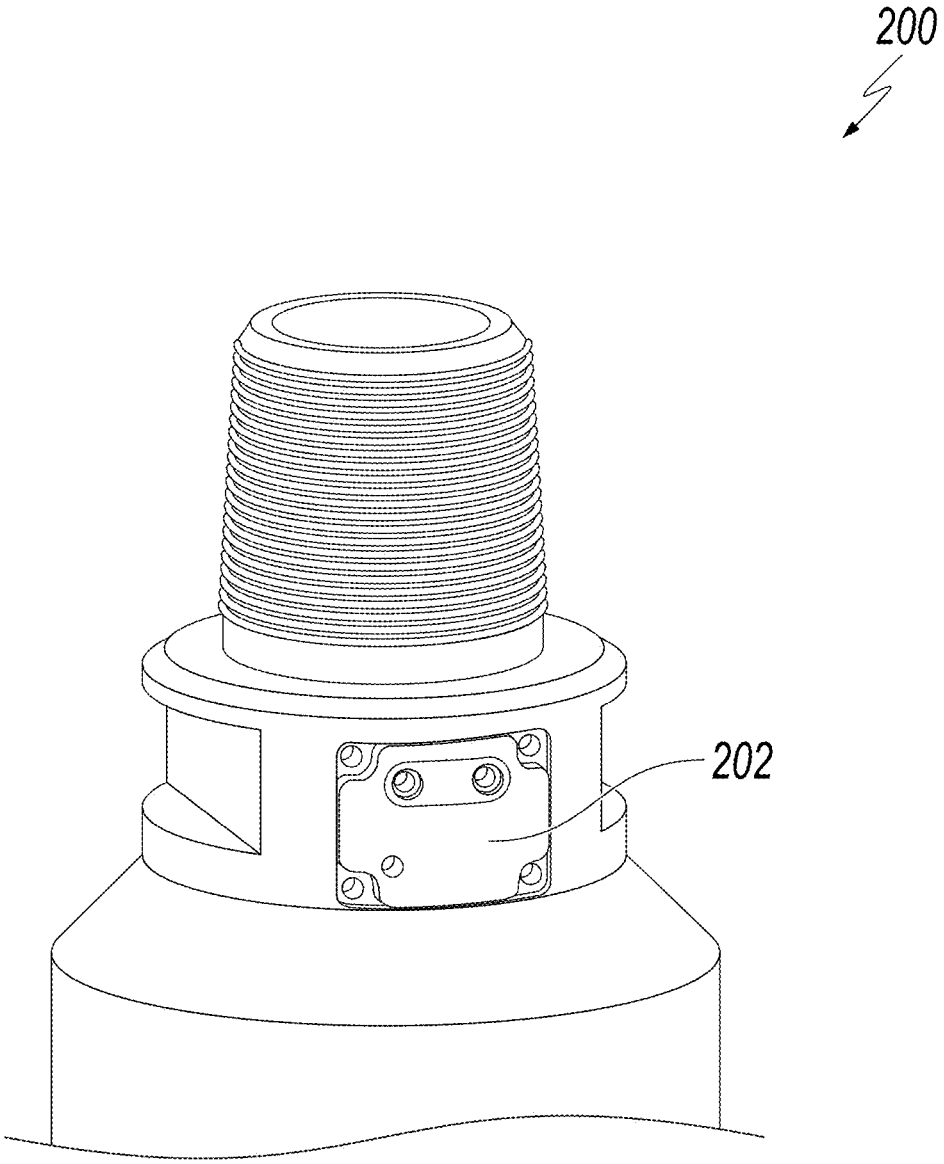
FIG. 2B is a perspective view of a blast-hole drill bit body having a wear sensor mounted thereon in accordance with an exemplary embodiment.

A bit body, shown in FIG. 2A, is an example of a blast-hole drill bit body with cavities 17. The bit shown has a steel body 13 with conical cutting diamonds 14 and cylindrical cutting diamonds 15 installed surrounding the cutting end 16. The drill bit attaches to the end of a drill pipe at a pipe end 18 by means of threads 19. High pressure air, foam, mist or water enters the drill bit through bore 20. A cavity 17 is machined into the bit to house the control module and transceiver antennas. Because cutters 14 and 15 are made up of hardened industrial diamonds, they do not wear as fast as the steel body 13. They are also expensive to make. When the steel body 13 wears to a point that cutters 14 and 15 may be at risk of detaching from body 13, the steel body is considered to be at its wear limit. Currently the means of inspecting the bit is to pull the entire drill string from the hole and visually inspect it. FIG. 2B illustrates a perspective view of a blast-hole drill bit body 200 having a redundant transducer wear sensor and remote recessed reflector antenna 202 mounted thereon.

Figure 3A:
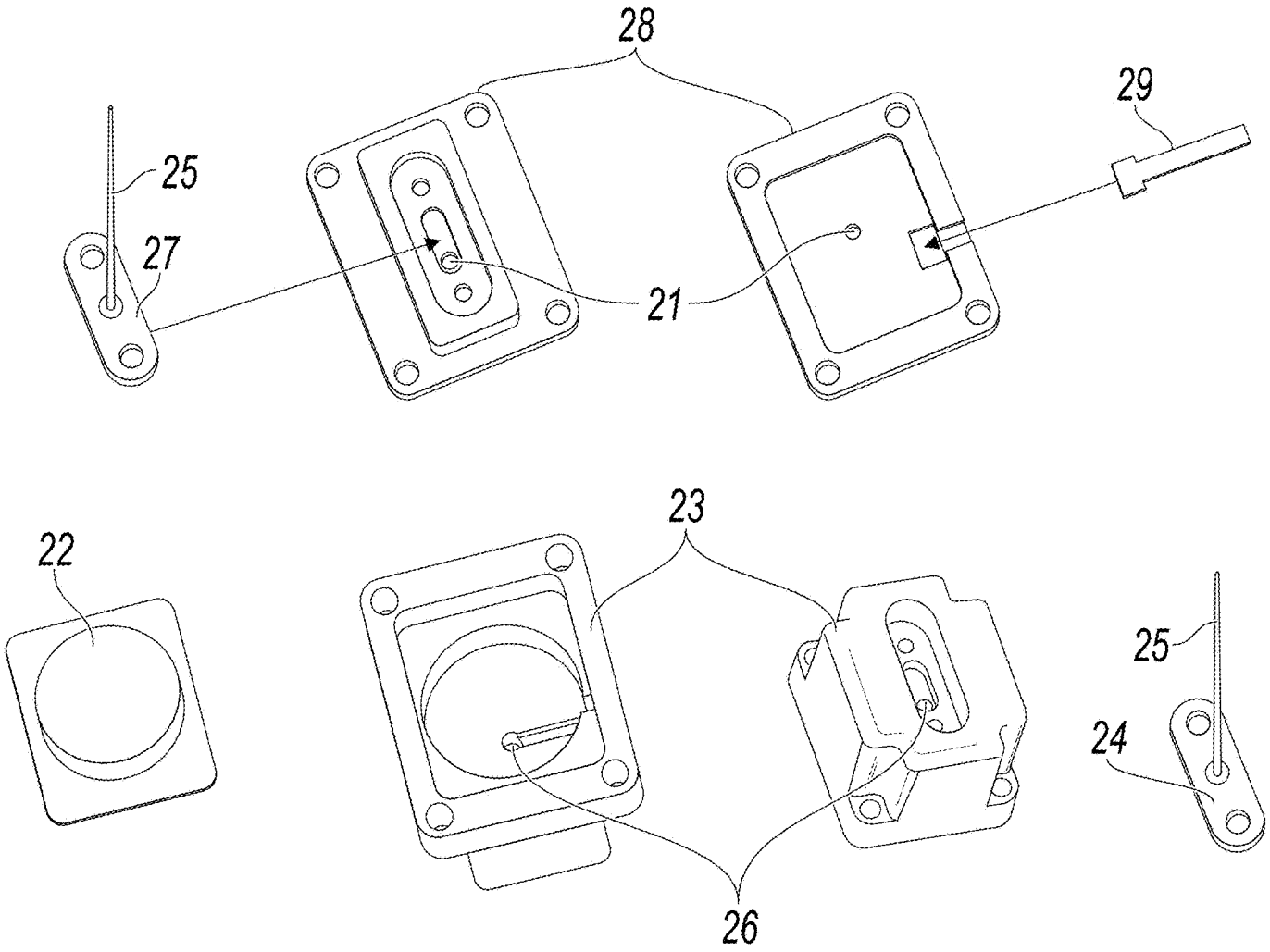
FIG. 3A-3B are exploded perspective views of antenna housings according to exemplary embodiments.
Figure 3B:
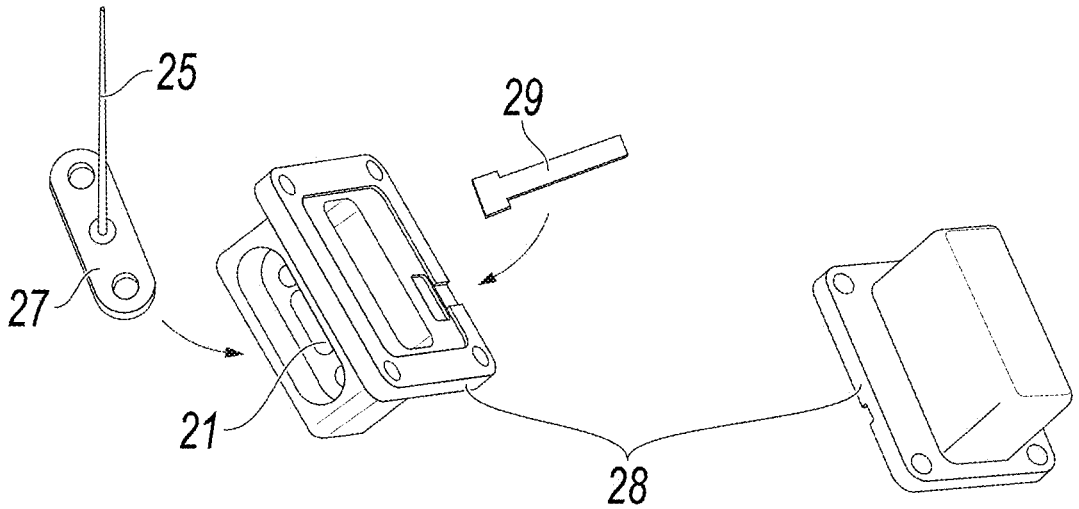
Figure 3B:
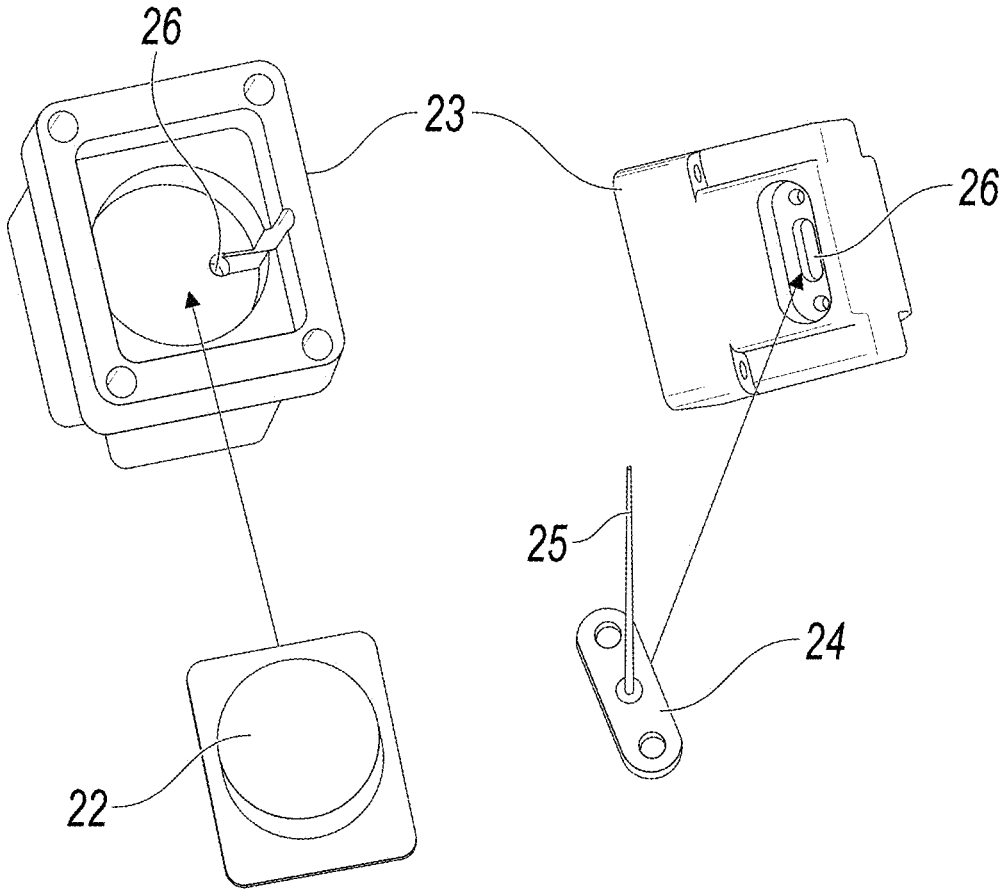

Installation of the Invention into the Drill Bit:

FIG. 3A (horizontal antenna orientation) and FIG. 3B (vertical antenna orientation) show details of two housings that may be inserted into cavity 17. Controller 22 is embedded inside cover 23. Inside and outside faces of the cover 23 and base 28 are both shown. The external antenna 24 PCBA fits into the top of the cover 23 using two screws. The external antenna cable 25 routes through hole 26 in the cover and attaches to controller 22. The internal antenna PCBA 27 mounts in the cavity on the bottom of the housing base 28. The external antenna cable routes through hole 21 and attaches to controller 22. The redundant resistor wear transducer 29 mounts into the side of housing base 28 and is attached to controller 22. The antennas are both assembled as recessed reflectors. Controller 22 has built-in acceleration and temperature monitoring sensors. In various embodiments, pressure and other sensors may be added as required. The drill bit is generally located in the bottom of the blast hole while drilling. The sensor and antenna may be located directly on the bit or on a sub between the bit and drill string. A complimentary set of antennas and transceivers could be located as a repeater along the drill string, and could be located at the top of the blast hole to receive the data from the transducers and forward it to a drill computer, handheld or wearable device or network node.

Figure 3C:
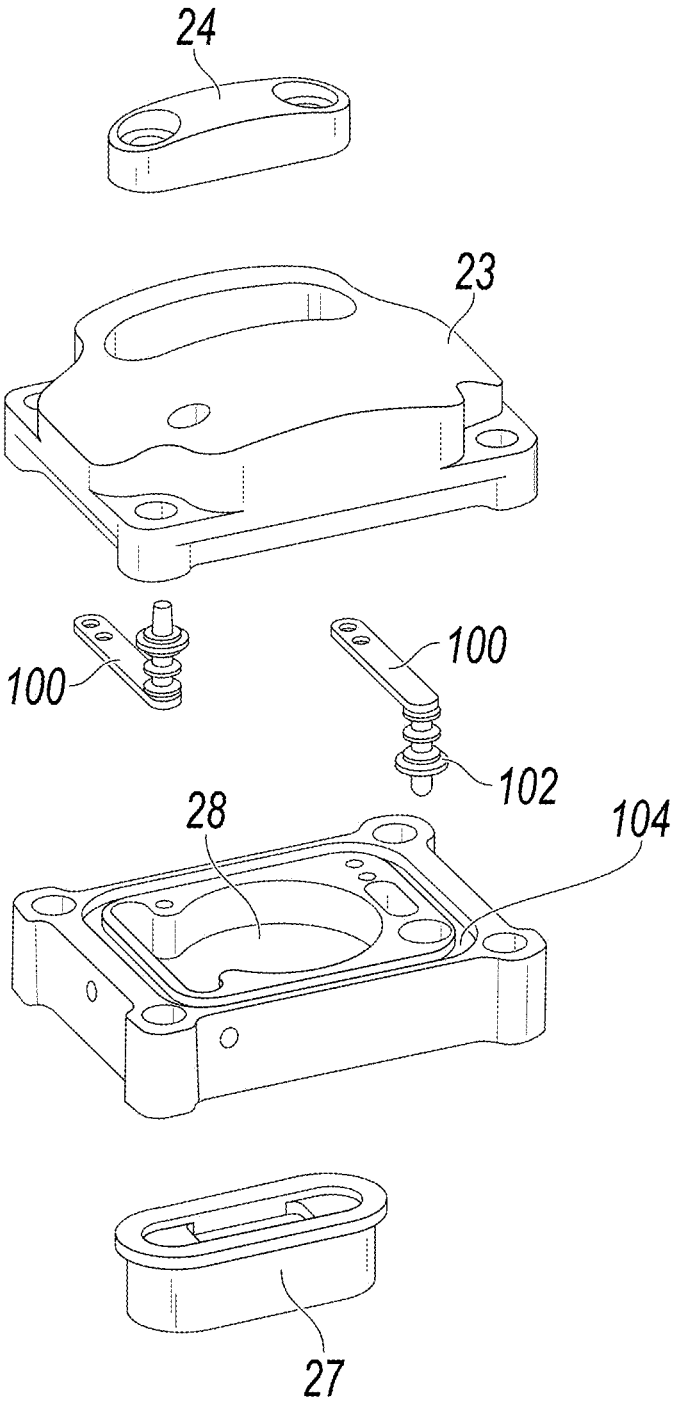
FIG. 3C is a top exploded perspective view of an antenna housing according to an alternative exemplary embodiment.
Figure 3D:
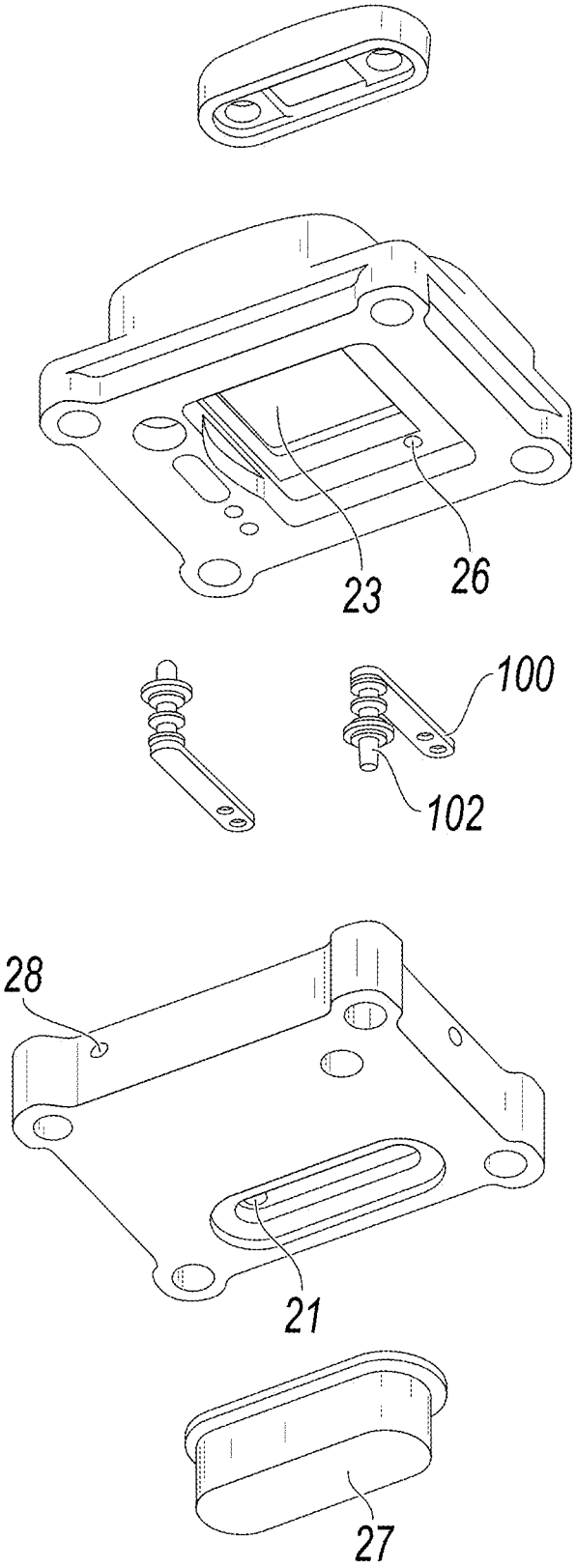
FIG. 3D is a bottom exploded perspective view of the antenna housing of FIG. 3C according to an alternative exemplary embodiment.

FIGS. 3C and 3D are additional embodiments of the housing that may be inserted into the cavity in the drill bit or drill bit collar. Controller 22 (shown in FIG. 3B) is embedded inside the cover 23. Inside and outside faces of the cover 23 and the base 28 are both shown. The external antenna 24 (shown in FIG. 3A) of the PCBA fits into a polymer insert 106. In a typical embodiment, the insert 106 is constructed of, for example, polytetrafluoroethylene ("PTFE") or another appropriate material. The insert 106 fits into the top of the cover 23 using two screws. The external antenna cable 25 (shown in FIG. 3B) routes through hole 26 in the cover and attaches to controller 22. The internal antenna PCBA 27 (shown in FIG. 3A) mounts to a polymer insert 108. In a typical embodiment, the insert 108 is constructed of, for example, polytetrafluoroethylene ("PTFE") or another appropriate material. The insert 108 mounts in the cavity on the bottom of the housing base 28. The external antenna cable routes through hole 21 and attaches to controller 22. The antennas are both assembled as recessed reflectors. Controller 22 has built-in acceleration and temperature monitoring sensors. Pressure transducers 100 are mounted to the cover 23 and base 28 such that the plungers 102 of the pressure transducers 100 rest in the cover holes 104.

Intelligent Wear Monitoring

Figure 4:
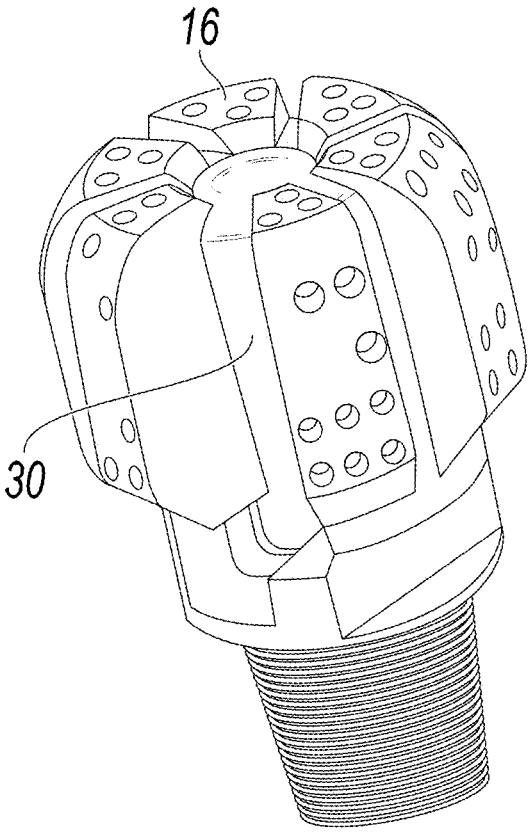
FIG. 4 is a perspective view of a drill bit illustrating wear path according to an exemplary embodiment.

Bit body wear may also be monitored. FIG. 4 shows an example of a wear path. In this bit, the wear-path 30 is the path from the cutting end 16 of a new drill bit to the wear-out limit that is to be monitored. The wear monitoring PCB is installed from the wear path to the controller. The Blast Bit implementation process begins by defining the wear paths in the bits that are to be monitored. Because each bit has unique characteristics, the wear paths that should be monitored and will differ in both location and wear depth. The wear rate at different points will vary based on the drill bits engagement with the materials being moved. A small bit may only require one wear-path to be monitored. Larger units may require multiple wear-depths to be monitored. Wear depth monitoring is accomplished for each wear-path by embedding transducers at intervals along the path. As the bit surface wear reaches a transducer, its characteristics are altered. The bit design is to include any type of transducer that may be used to detect wear on the bit. The use of resistors as transducers is given here as an example. The wear path monitoring is an option that may or may not be present. Vibration and temperature may also be used to monitor wear in place of the wear monitor circuits.

Figure 5:
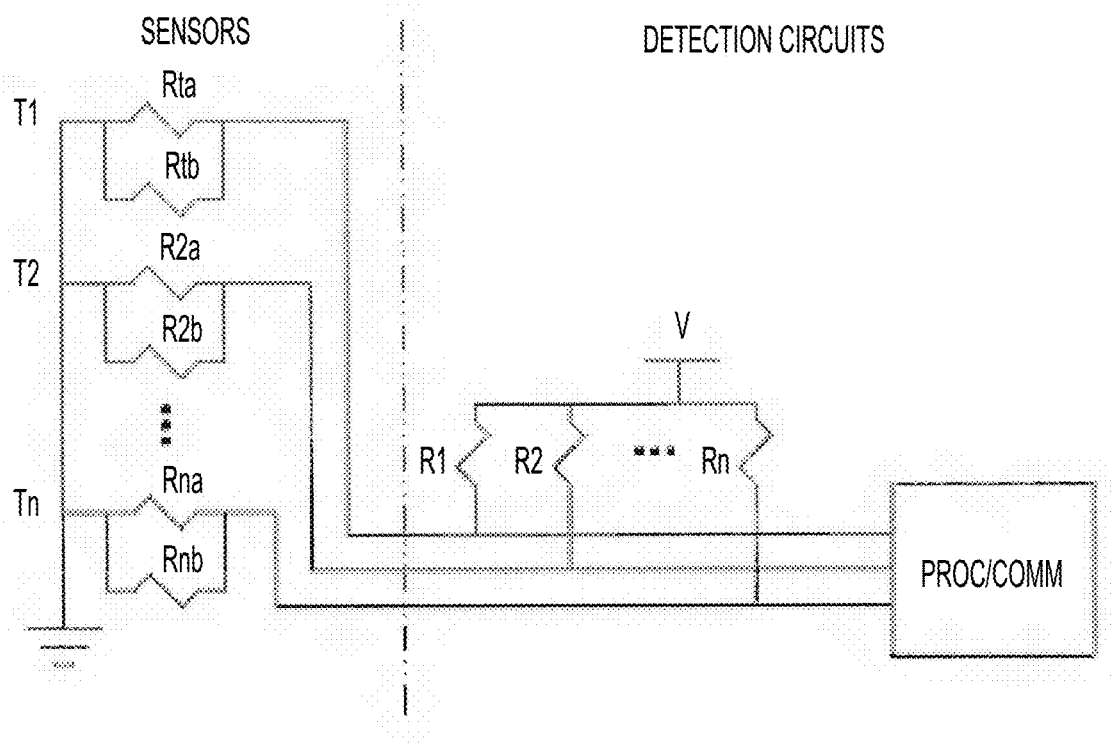
FIG. 5 is a circuit diagram of a wear-detection system according to an exemplary embodiment.

Direct Wear Monitoring Using Redundant Resistors as Transducers:

FIG. 5 shows the wear detection circuits. Although this application is not limited to a specific type of transducer, the use of resistor pairs (redundant resistors) for monitoring, is given here as an example.

Still referring to FIG. 5, T1 is embedded nearest the outer wear surface with T2 through Tn equally spaced along the wear path. Tn is located closest to the wear limit. When the path wears down to a resistor pair, such as, for example, R1*a* and R1*b*, the combinatorial resistance of the resistor pair changes. The resistance can be reduced or shorted (if filled with debris) or increased or open (if the connections or resistor are damaged or broken). The change in resistance indicates to the processing device that the wear depth for the resistor pair has been reached. Although not shown in the schematic, the traces may also be made redundant by use of more traces and circuit board layers to decrease the probability of false indications due to faulty trace failures.

Redundant transducers and traces improve the monitoring reliability of the sensors. Single component, connection, or trace failures resulting from defects in manufacturing, extremes in temperature, shock, or vibration of the operating environment are detected and compensated for in the processing circuitry. As an example, if the parallel combination of R1*a* and R1*b* equals the value of R1, the analog voltage detected at the processor input is V/2. If a failure of R1*a*, R1*b* or a connection or trace path to either of these resistors results, due to a manufacturing fault, temperature extremes or from shock or vibration, one of the resistors will be omitted from the circuit. This will result in the resistance of R1 being half the resistance of the remaining connected resistor (R1*a* or R1*b*). The voltage detected at the input will then be V/3. This voltage level will indicate to the processor that the failure may not be related to wear. If the voltage level is due to wear, it will not make a difference. The other resistor will soon be removed by wear. Until both resistors in the pair are faulted, the wear-point will not be considered to have been reached. In sensors that do not have redundancy, failures in any of the traces or transducer will incorrectly indicate that the wear point was reached.

Figure 6:
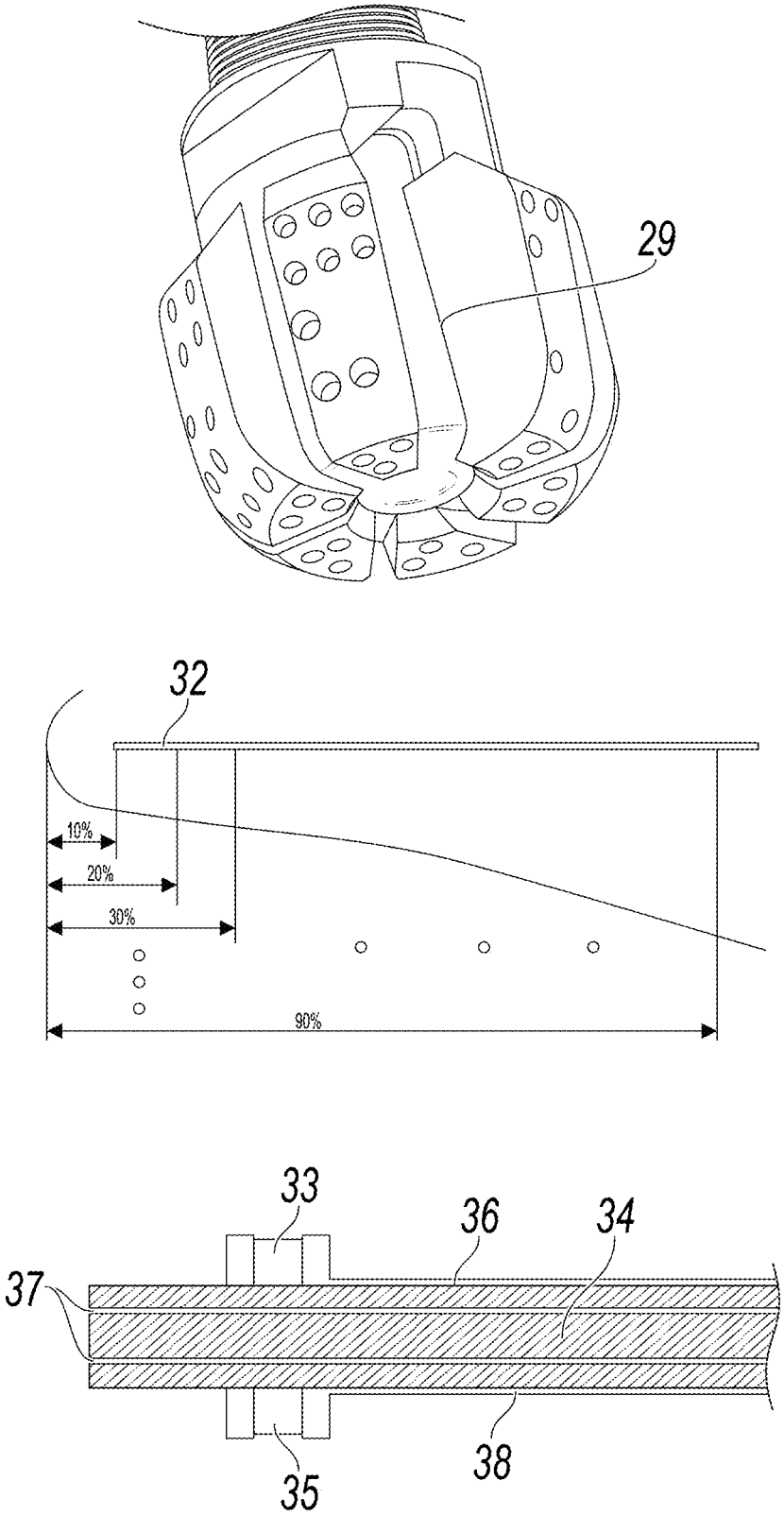
FIG. 6 is an illustration of an installation of a sensor into a wear path according to an exemplary embodiment.

FIG. 6 shows how the physical implementation of the sensor may be accomplished by inserting it into a small hole located along the wear path, as shown on FIG. 6 for wear path 29, defined previously. The voids around the sensor may be filled with a compound, such as epoxy, to protect the sensor from damage due to shock or vibration.

Expanding into the sensor diagram shows the spacing of the individual resistor pairs 32 which are broken away when the wear reaches them. In this example, the resistors are spaced at intervals that will indicate wear in increments of approximately 10%.

The previous drawing was further expanded to show the details of one redundant resistor pair. One resistor 33 is located on the top surface of circuit board 34, the other resistor 35 is located on the bottom side. Traces that carry sensor signals are on the top 36, middle 37 and bottom 38 layers of the circuit card.

Putting traces 36, 37, and 38 on multiple circuit board layers reduces the width of the circuit board to fit in a smaller hole in the drill bit. By way of example, this example uses a pair if resistors 33 for redundancy. The use of more transducer parts to increase the redundancy is considered a part of this invention.

Indirect Wear Monitoring Using Accelerometers:

As the bit wears, the characteristics of its rotation in the hole will change. Accelerations associated with bit rotation can be monitored by accelerometers on the bit or bit collar and the amount of wear can be estimated. Monitoring wear in this way does not require installation of an embedded wear ladder. A high degree of whirl, for example, is indicative of significant bit wear. If acceleration readings suggest that the bit is violently whirling in the hole, notification can be sent to the operator to check the bit for wear.

Indirect Load Monitoring Using Strain Gauges:

Parameters like torque on bit and weight on bit are typically estimated using sensors and gauges on the drill rig. These estimations can be inaccurate because there may be something happening between the drill rig and the drill bit such that all the forces from the rig are not transferred to the bit. Strain gauges located on sides walls of the cavity 17 of the bit may be used to better infer the torque and weight on bit. The strain at any given location on the bit is related to the stresses on the bit. To associate strain read by the gauges and stress on the bit, the system must be calibrated. Known stress is applied to the bit and the strain read. When unknown stresses associated with torque and weight on bit are applied, strain can be used to calculate those stresses.

Figure 8A:
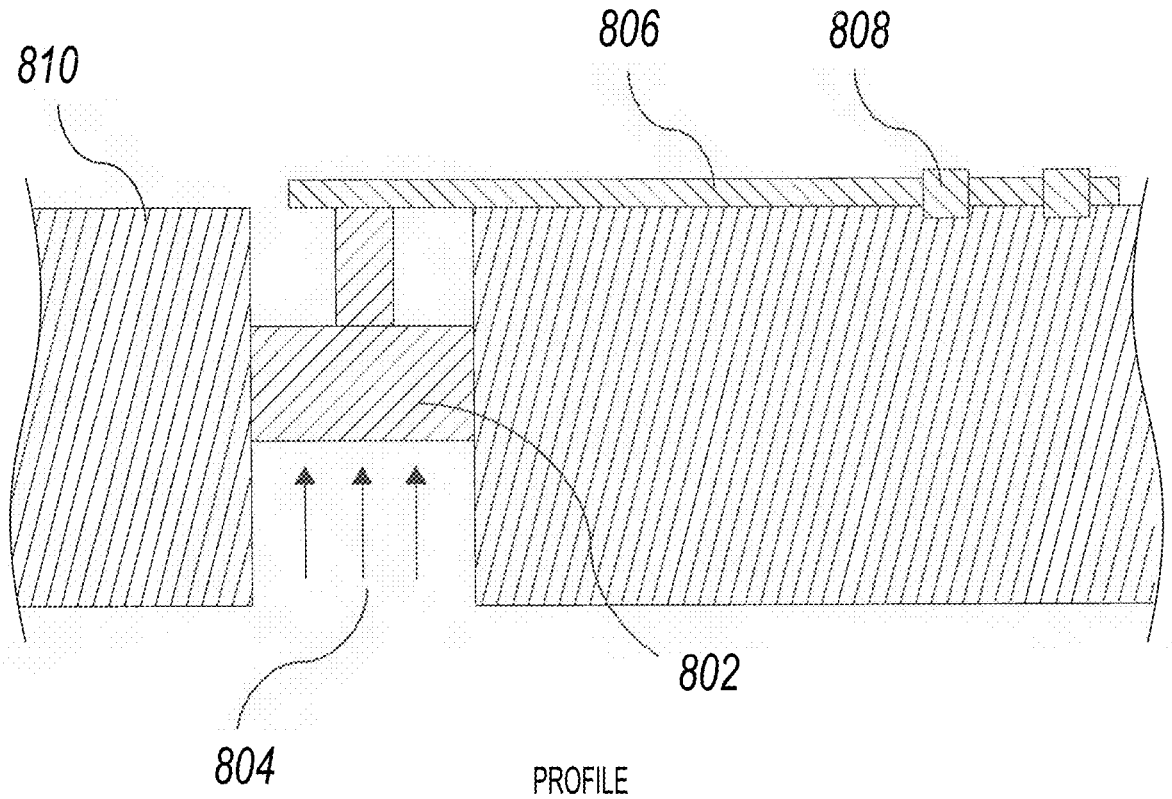
FIG. 8A is a profile view of a pressure monitoring system according to an exemplary embodiment.
Figure 8B:
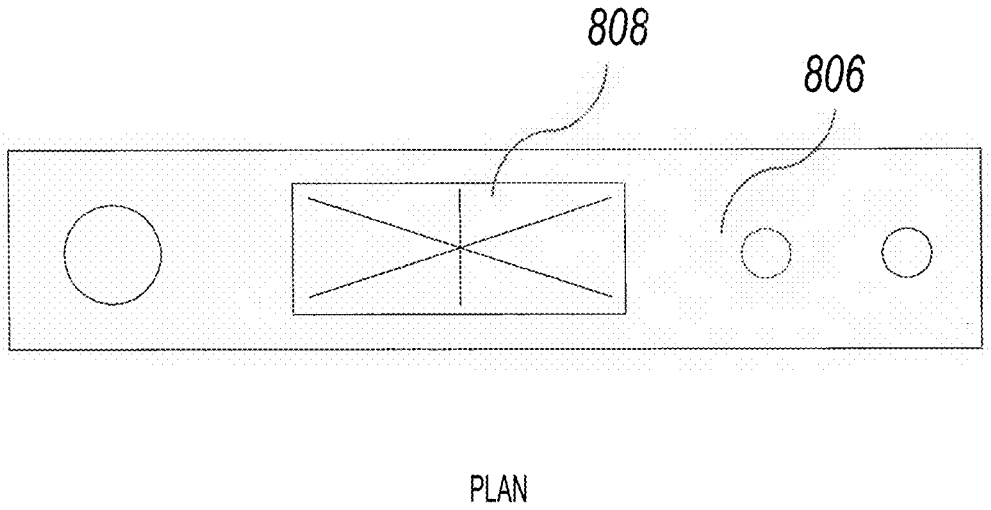
FIG. 8B is a plan view of the pressure monitoring system of FIG. 8A according to an exemplary embodiment.

Pressure Monitoring Using Plunger, Lever Arm, and Strain Gauges:

Pressure may be monitored using a system that includes a plunger, lever arm, and strain gauge. FIGS. 8A-8B illustrate this concept. The plunger 802 is located within a cylinder 804 such that it can move axially, as would a piston. The plunger 802 acts as a seal between the inside and outside of the system, where pressure is known and constant in said inside of the system. A lever arm 806 fixes the system to the chassis that is installed on the bit or bit collar 810. On the lever arm is a strain gauge 808. As the differential pressure changes, the plunger moves inward or outward within the cylinder with most of the resistance to inward movement provided by the lever arm 806. The strain on the lever arm 806 is related to the stress on the lever arm, which is related to the pressure on the plunger.

Transmission of Monitored Data to the Machine Operator:

From the perspective of monitoring the wear of a bit body, since there are no practical means of attaching wires for communication, the application is considered to be remote. The monitoring electronics are embedded in the bit and the bit is used to cut rock, ore, and other harsh abrasive materials. Powering the electronics and sending the signals to the operator is a challenge. For the bit, the monitoring electronics are to be powered by battery. The batteries and controller are installed as a module using screws. If the battery or controller fail during operation, it is possible to replace them to extend the life of the bit. When the bit is worn out, it is possible to move the controller and battery to another bit, however, the wear sensor will need to be replaced, since it wears away with the bit.

Transmission of data is accomplished by use of recessed antennas mounted in the surfaces of the drill bit which are least exposed to abrasion. The antenna may be encapsulated or otherwise covered with materials that will best withstand the abrasion. PTFE (Polytetrafluoroethylene, also known as Teflon) is an example of one material that may be well suited to this application for the following reasons: it has low surface friction; it is rigid; and it does not significantly attenuate radio frequency transmissions. Small gaps around covers made of materials such as PTFE, may be sealed from moisture using epoxy or other suitable sealants. The size of the aperture used for wireless transmission must be minimized to best protect the antenna and associated circuits. One or more antennas may be implemented for this application, based on the need to radiate and receive signals in multiple directions. An example embodiment of remote dual antennas with recessed reflectors is shown in FIG. 6.

Figure 7:
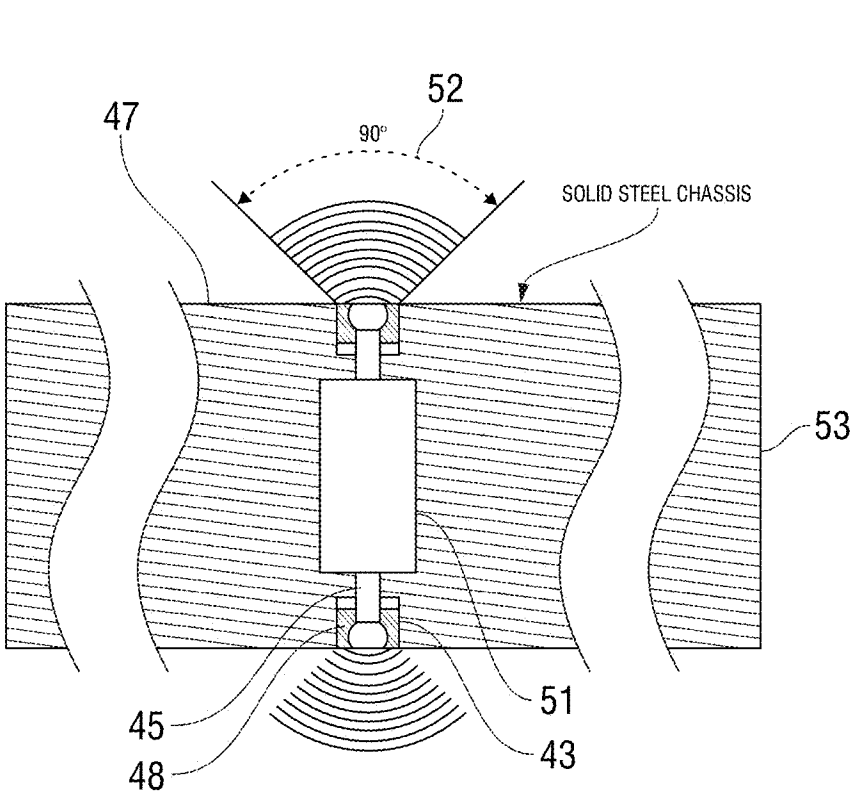
FIG. 7 is a diagrammatic illustration of a recessed reflector antenna according to an exemplary embodiment.
Figure 7:
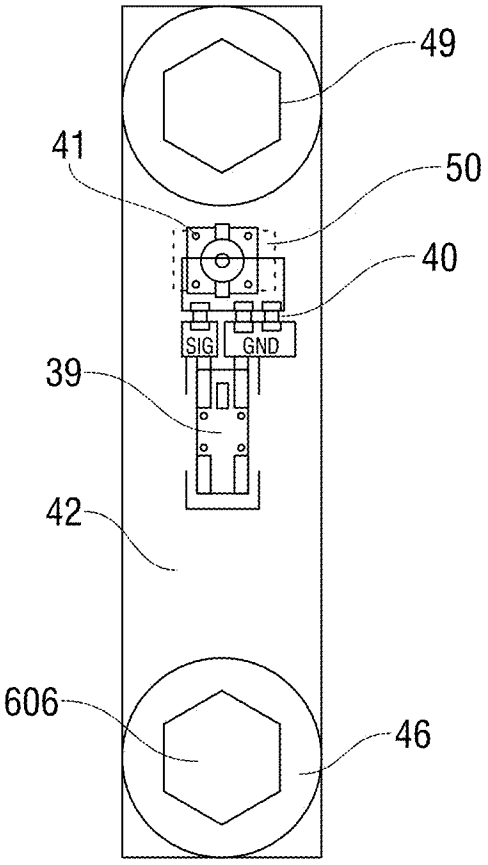

Referring now to FIG. 7 the antenna 39, series and shunt tuning components 40, and cable connector 42 are mounted on a small circuit board 42 that is positioned in the antenna cavity 43 with two mounting holes 44 aligned with threaded screw holes 45 in the bottom of the antenna cavity 43. The bottom sides of the two screw holes 44 in the circuit board 42 have exposed annular rings 46 that are conductively bonded to the steel surface of the bottom of the cavity 43 using an electrically conductive compound. This conductive joint between the grounded PCB 30 annular rings 46 extends the circuit board 42 ground plane into the steel chassis 53. This overall ground plane acts as the reflector for the antenna. The current means of mounting these types of antennas is on the edges of flat corner surface reflectors. Mounting the antenna 39 on flat surface corner reflectors is not possible because the surfaces 47 are 'wear-surfaces' (the antenna 27 would be immediately destroyed) and the surfaces are contoured such that they have no corners. Recessing the antenna 39 into the surface prevents it from being scraped off by rock and debris.

The antenna 39 and circuit board 42 is further protected with a cover 48 formed out of a material (such as PTFE) that fills the cavity 43 in front of the antenna 39 and which is attached by means of two screws 49. Connectors 41 are attached to RF cables 50. RF cables 50 carry signals to and from the transceiver and processing circuit board 51. Dimensions of the cavity allow the radiation pattern 52 to be ninety degrees (or greater, by means of altering these dimensions, when practical). The set of cavity 43 dimensions in this example may obviously be altered, as required, for similar embodiments of this invention. Recessing the antenna 39 changes the radiation characteristics from an omnidirectional configuration that is characteristic of radiation reflected off a flat reflector to radiation reflected off of a horn antenna. This will make the antenna 39 beam operate in a directional pattern.

Because the antennas are mounted in a drill bit, the signal radiation will deflect off of other objects, such as adjacent, drill parts, walls of the blast hole and drill pipes or the drill rig at the top of the hole to disperse to the antennas on the other end of the transmission. In some cases, if a drill is mounted in an area where wires may be used for data transmission, wired technology may also be used.

Boring machines are used to excavate vertical or horizontal shafts in the mining and tunneling industries. With raise boring, a pilot hole is drilled from the surface to intercept the subsurface workings. After the pilot hole has penetrated into the workings, a boring head having several rolling cutters (often called a cutting head) is fixed to the end of the drill string. The raise boring machine then pulls the cutting head towards the surface as it rotates, cutting and breaking rock that falls down to the workings where it can be hauled out. As opposed to blind boring, raise boring requires subsurface workings to be connected to the shaft to be excavated before the shaft can be constructed. The invention described herein relates to both raise boring and blind boring machines.

Figure 9:
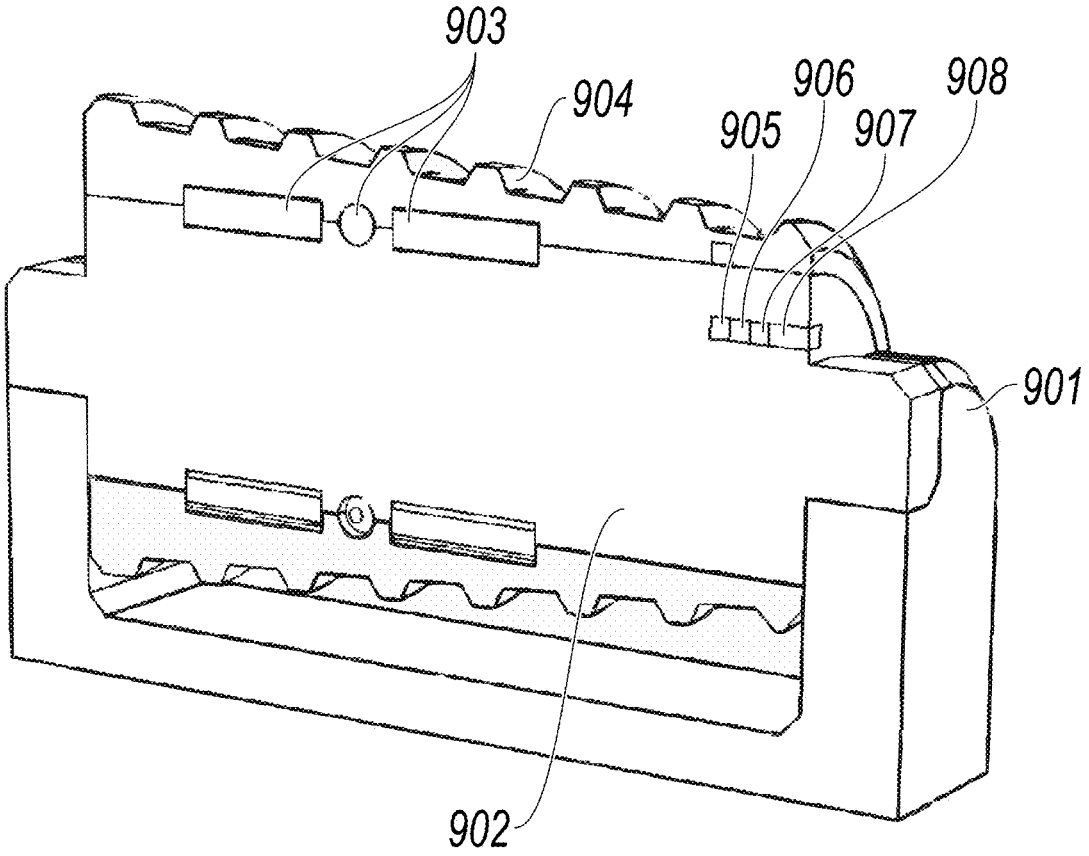
FIG. 9 is a cutaway perspective view of a boring machine cutter assembly according to an exemplary embodiment.

In an exemplary embodiment shown in FIG. 9, the cutter assembly consists of a mounting saddle 901, mounting shaft 902, bearings 903, and cutter sleeve 904. The mounting shaft 902 has embedded in it a number of sensors 905 connected to a printed circuit board (PCB) 906 that is powered by a battery 907. A magnet may be embedded in cutter sleeve 904 for a magnetometer as one of the sensors 905 to detect rotation speed of the cutter sleeve 904. The PCB 906 is in communication with a recessed radio frequency (RF) transceiver antenna. A cover made of a dielectric material such as Teflon (PTFE) 908 is sealed into the PCD/battery cavity to protect the system from the outside environment. The dielectric material allows from radio RF signal to pass through it.

Figure 10:
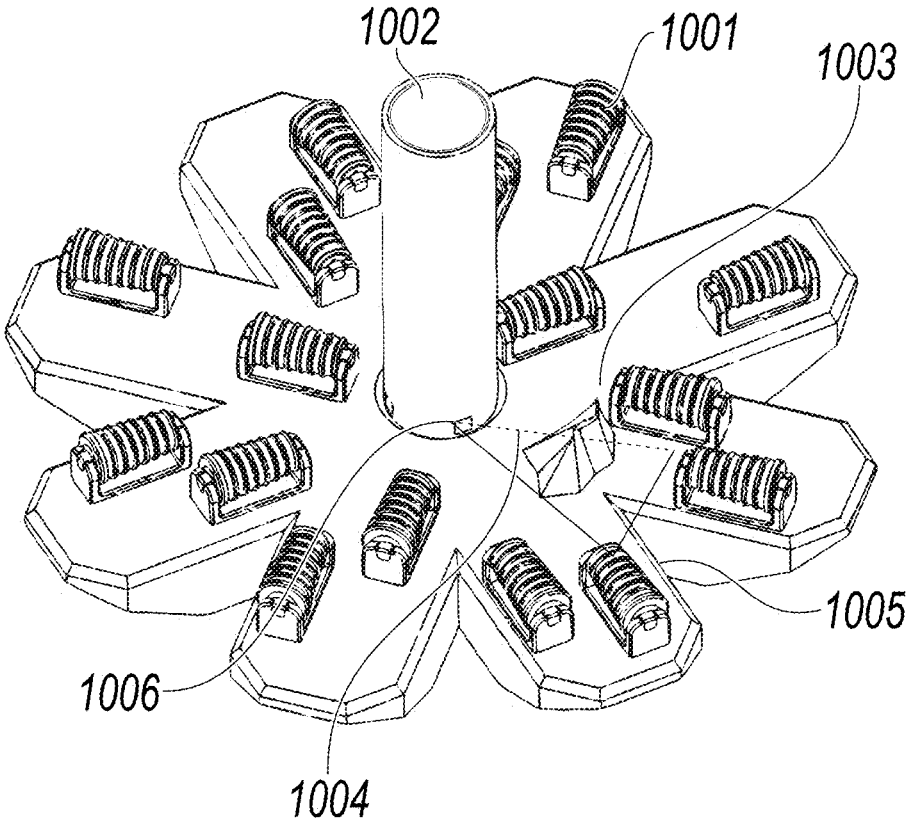
FIG. 10 is a perspective view of a boring machine cutter head assembly, comprising of a plurality of boring machine cutter assemblies according to an exemplary embodiment.

Each cutter assembly monitoring system has the ability to communicate with other cutter assemblies in a wireless mesh network, as shown in FIG. 10. This has the advantage of still being able to communicate information from a cutter assembly 1001 to the central drill pipe 1002 even in the case that rock material 1003 has obstructed the line-of-sight transmission between the transceiver antenna on the cutter assembly 1001 and receiver antenna 1006. The blocked line-of-sight 1004 is replaced by a relay path 1005 that is a detour around the obstruction 1003. Cutter assemblies may also be able to communicate with at least one central receiver antenna 1006.

In one embodiment, the central receiver antenna 1006 may be a transceiver or connected to a transmitter antenna that sends the signal up the annulus of the drill pipe 1002 and pilot hole wall, using repeater transceivers embedded in the outside of the drill pipe 1002. The nature of this embedment of antennas is discussed in the section "Description of the Recessed Reflector Antenna."

In another embodiment, the central receiver antenna 1006 is embedded in a dielectric window that allows RF to reach the inside of drill pipe 1002 while the drill pipe 1002 remains sealed. The receiver antenna 1006 may be a transceiver or connected to a transmitter antenna that sends the signal up the center of the drill pipe using repeater transceivers embedded in the inner wall of the drill pipe 1002. The nature of this embedment of antennas is discussed in the section "Description of the Recessed Reflector Antenna."

Figure 11:
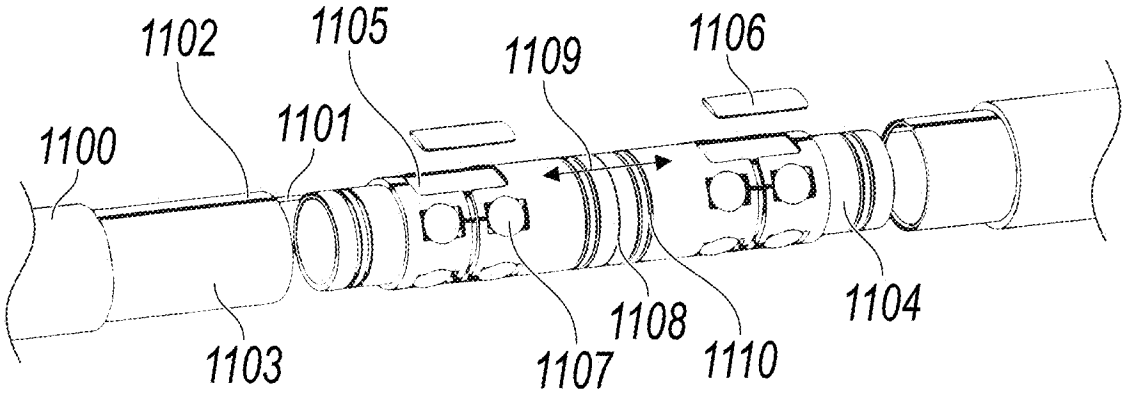
FIG. 11 is an exploded perspective view of a rod communication system according to an exemplary embodiment.

In another embodiment shown in FIG. 11, the receiver antenna is embedded in a dielectric window that allows RF to reach the inside of drill pipe 1100 while the drill pipe 1100 remains sealed. The receiver antenna is connected to a wire 1101 that is run through a conduit 1102 cut into a pipe insert 1103 having female end connections. The pipe insert is molded to the inner surface of the drill pipe 1100. Near the ends of the drill pipe, the female end connections of the pipe insert 1103 are connected to the male end connections of PCB/battery housings 1104. The wire 1101 is in communication with the PCB 1105 which has a sealed cover 1106. The PCB is powered by batteries 1107 and in communication with a transmitter or receiver antenna. When a drill pipe joint 1108 is made up, the two PCB/battery housings 1104 of the two drill pipes 1100 are butted together, completing a path 1109 that a RF signal from a transmitter antenna can pass through to communicate with the receiver antenna on the other side of the pipe joint 1108. O-ring grooves 1110 accommodate O-rings to seal the electronic components from moisture.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. An intelligent blast-hole drill bit comprising:
a housing embedded into a cavity in a bit body;
a controller disposed in the housing;
an external antenna disposed in the housing and coupled to the controller;
an internal antenna disposed in the housing and coupled to the controller; and
a wear transducer disposed in the housing and coupled to the controller.

2. An intelligent boring machine bit comprising:
a housing embedded into a cavity in a bit body;
a controller disposed in the housing;
an external antenna disposed in the housing and coupled to the controller;
an internal antenna disposed in the housing and coupled to the controller; and
a wear transducer disposed in the housing and coupled to the controller.

* * * * *